United States Patent [19]

Spinner

[11] 4,001,730

[45] Jan. 4, 1977

[54] VARIABLE DIRECTIONAL COUPLER HAVING MOVABLE COUPLING LINES

[76] Inventor: Georg Spinner, Erzgiessereistr. 33, 8 Munich 2, Germany

[22] Filed: July 16, 1975

[21] Appl. No.: 596,290

[30] Foreign Application Priority Data

July 16, 1974 Germany ..... 2434144

[52] U.S. Cl. ..... 333/10; 333/97 R

[51] Int. Cl.[2] ..... H01P 5/04; H01P 5/18

[58] Field of Search ..... 333/10, 31 R

[56] References Cited

UNITED STATES PATENTS

| | | | |
|---|---|---|---|
| 3,166,723 | 1/1965 | Bock et al. | 333/10 |
| 3,363,201 | 1/1968 | Isaacson | •333/10 |
| 3,388,350 | 6/1968 | Butler | 333/10 |
| 3,560,885 | 2/1971 | Chao | 333/10 |

*Primary Examiner*—Paul L. Gensler
*Attorney, Agent, or Firm*—Ostrolenk, Faber, Gerb & Soffen

[57] ABSTRACT

A directional coupler for coaxial cable, or the like, wherein the portions of the lines to be coupled are positioned to run next to each other, thereby defining a gap between them that is in a plane that extends generally parallel to the planes of the lines connected. For adjusting coupling attenuation, the gap width is changed by moving the overlying sections of the lines in a direction perpendicular to the axes of the connection lines.

9 Claims, 6 Drawing Figures

VARIABLE DIRECTIONAL COUPLER HAVING MOVABLE COUPLING LINES

The invention relates to a coaxial directional coupler, preferably a 3dB coupler, in which the coupling attenuation is adjustable by varying the air gap which determines the mutual spacing between the coupling lines.

Such a directional coupler is known from West Germany DT-OS 2,326,810. In this case, the gap between the two coupling lines, constructed as strip lines, lies perpendicularly to the plane of the coaxial connection lines and the adjustment is effected by resilient bending of the coupling lines within the coupling section. The change of the coupling gas was effected substantially in the center of the coupling path whereas at the ends, at which the coupling lines are supported by the outgoing inner conductor portions, the gap width is practically invariable.

The problem underlying the invention is to provide a directional coupler having a variable coupling attenuation in which a sensitive adjustment of the gap between the two coupling lines can be made over the entire length of the coupling section with simple mechanical adjusting means.

According to the invention this problem is solved in a directional coupler of the type mentioned at the beginning in that the gap between the two coupling lines lies in the plane of the coaxial connection lines.

As a result, the movement direction of the coupling lines on adjustment of the coupling attenuation is in a direction perpendicular to the axes of the connection line and it is easily possible to make the inner conductor portions of the outgoing coaxial lines yield flexibly in a direction perpendicular to their axis, which can for example be done in that the end portions which carry the coupling lines are mounted via flexible bands. Alternatively or additionally the entire inner conductor of the connection piece may be offset within the insulating support carrying it by a small amount and for this purpose the insulating support may carry the inner conductor portion with radial clearance.

It is possible in this manner to shift the two coupling lines constructed as strip lines over their entire length substantially parallel to each other to change the coupling gap so that the coupling attenuation or the frequency response of the coupling attenuation of two or more couplers can be set in very accurate agreement. The invention makes it possible to change the spacing of the two coupling lines with small mechanical effort and the small distances through which the inner conductor connection pieces must yield on parallel displacement of the coupling lines can easily be accommodated.

Some examples of embodiments of the invention will be explained hereinafter with the aid of the drawings, wherein.

Figure 1:
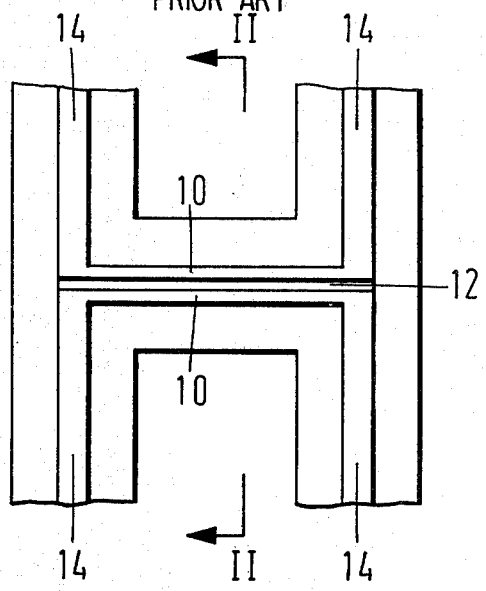
Fig. 1 PRIOR ART
FIG. 1 is a schematic illustration of a directional coupler representing the prior art in section, the plane of section lying in the plane of the coaxial connection lines.
Figure 2:
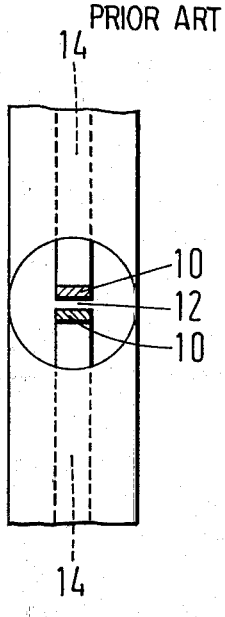
Fig. 2 PRIOR ART
FIG. 2 is a section along the line II—II of FIG. 1.

FIGS. 1 and 2 represent the prior art as disclosed for example in aforementioned West Germany DT-OS 2,326,810. In this case, the two coupling lines 10 lie so that the gap 12 therebetween, which is to be adjusted, lies perpendicular to the plane of the coaxial connection lines, i.e. perpendicular to the plane of the drawing according to FIG. 1. The two coupling lines must therefore be displaced in the direction of the axis of the outgoing coaxial lines 14 and because the inner conductors of the coaxial connections are axially rigid no change of the coupling gap can take place at the ends but only a bending, giving different gap widths over the length of the coupling line.

Figure 3:
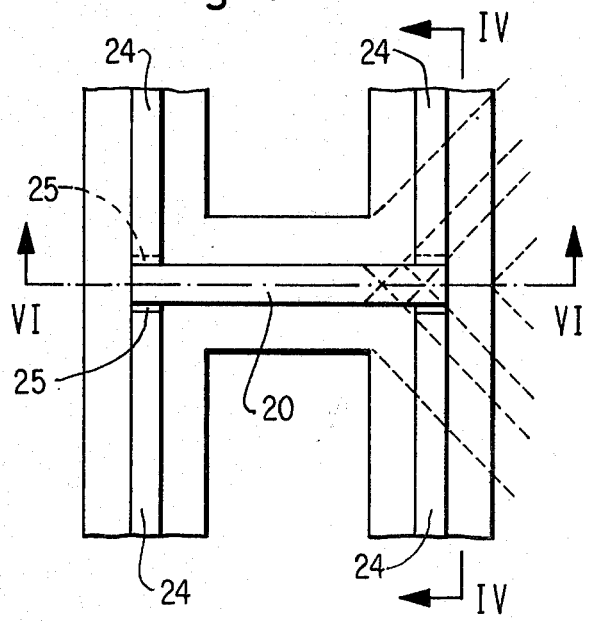
FIG. 3 is a schematic view corresponding to FIG. 1 of a directional coupler constructed according to the invention.
Figure 4:
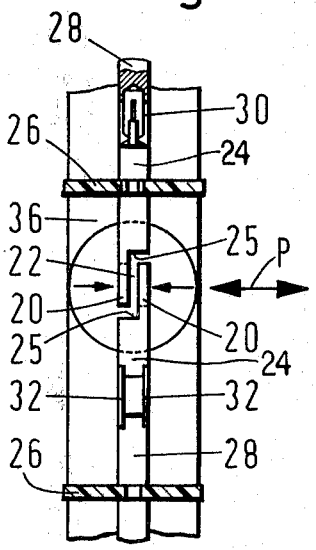
FIG. 4 shows to a larger scale a section along the line IV—IV of FIG. 3 with two different connection possibilities for the inner conductor portions.
Figure 5:
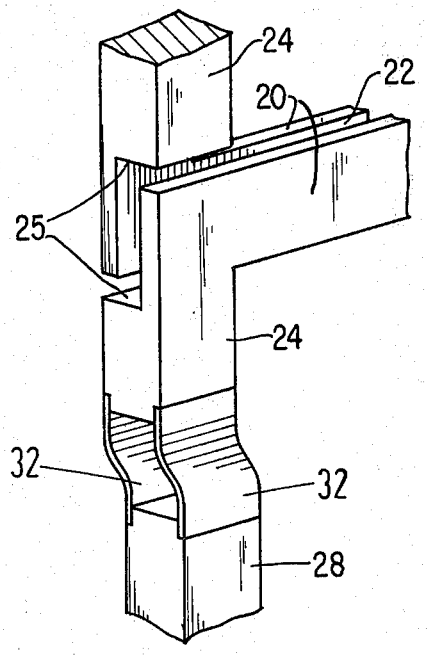
FIG. 5 is a perspective view of the flexible connection illustrated in FIG. 4 at the lower inner conductor.

According to the invention the arrangement is such that the coupling gap 22 lies in the plane of the coaxial connection lines, i.e. in the plane of the drawing according to FIG. 3. The two coupling lines 20, which are in the form of strip lines, are therefore moved with respect to each other in the direction of the arrow P according to FIG. 4 to adjust the coupling attenuation. To transmit this adjustment movement, which requires only very small travels, to the inner conductors of the coaxial connections as well the inner conductor connection pieces 24 are provided as shown in FIGS. 4 and 5 with a step 25 so that the coupling conductors 20 are opposite each other over the entire length. The mutual position of the coupling strip lines 20 and the inner conductor end portions 24 which support them permits by small radial yielding of the inner conductor end portions 24 a parallel adjustment of the two coupling conductors with respect to each other over the entire length. The radial yielding, which requires only very small travels, may be facilitated in that as shown in FIG. 4 the inner conductor end portions 24 are mounted with radial clearance in the insulating support 26 carrying them. The insulating support may also be lined on the periphery with a resilient material of low high-frequency losses and thus permit the necessary movement of the inner conductor.

To improve the flexibility with the adjoining inner conductor piece 28 resilient connections may be provided. According to the example of embodiment illustrated at the top of FIG. 4 the resilient connection is effected via a contact spring rim 30 which permits a certain radial movement. Said contact spring rim 30 may also represent the plug connection for the inner conductor.

In the example of embodiment illustrated at the bottom of FIG. 4 the resilient connection is effected by strips 32 arranged for parallel displacement.

Figure 6:
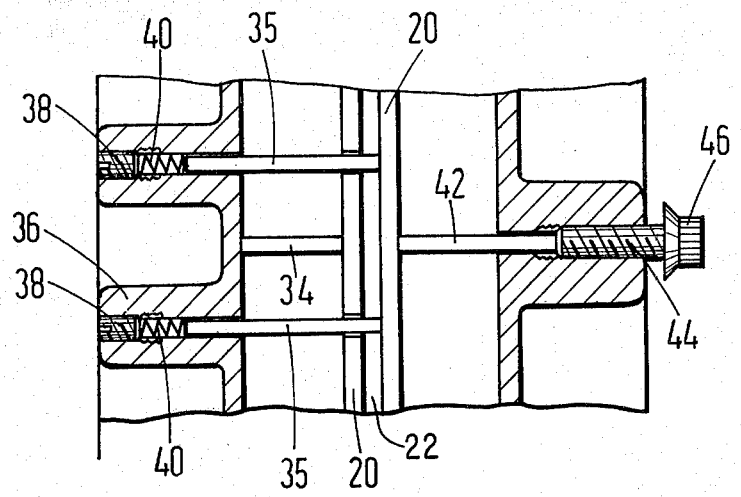
FIG. 6 is a section along the line VI—VI according to FIG. 3 to a larger scale.

FIG. 6 illustrates one possibility for the mechanical adjustment of the coupling gap. The one coupling conductor is fixedly supported via an insulating support 34 in the housing 36 of the directional coupler. The opposite coupling conductor is supported via insulating support rods 35 which are led through holes in said first coupling conductor and on the one side supported at the adjustable coupling conductor and on the other side guided in guide bores 38 of the directional coupler housing 36 and supported by springs 40. An adjusting pin 42 of insulating material acts on the adjustable coupling conductor from the other side and is axially adjustable in an adjustment thread 44 of the directional coupling housing 36 by means of a rotary knob 46.

Such an adjusting means is preferably provided in the center of the coupling section but may also be arranged at two or more points. In this manner, an extremely sensitive adjustment is possible in both directions, in the direction reducing the coupling gap by rotating the adjusting pin 42 so that the support rods 35 are moved against the force of the springs 40. If it is necessary to increase the size of the coupling gap the adjustment pin 42 is moved back and the springs 40 push the movable strip conductors back in the sense of increasing the coupling gap via the support rods 35.

In the example of embodiment illustrated the one coupling conductor is disposed rigidly in the directional coupling housing 36 and the other is movably mounted. Alternatively, however, both coupling conductors may be moved towards each other or away from each other via a simple mechanical adjustment drive in the directional coupling housing in order to change the coupling gap.

In all embodiments, the movement of the two conductor portions with respect to each other may be carried out during operation from the outside, a scale conveniently being provided which permits an exact determination of the relative position of the two coupling conductors and of the coupling gap.

According to the example of embodiment illustrated the outer conductor of the directional coupler is made with a circular cross-section. According to a further development of the invention it may however also have a square or rectangular cross-section.

According to the example of embodiment illustrated in FIG. 4 the contact spring rim 30 engages round a cylindrical extension of the inner conductor portion 24. If relatively large radial movements are necessary it may be advantageous to allow the contact spring rim to slide on a spherical inner conductor portion. This contact spring rim may simultaneously establish the plug connection to the terminal.

The directional coupler constructed according to the invention is particularly suitable for adjusting the coupling attenuation from outside as illustrated in the example of embodiment. The arrangement of the coupling conductors with coupling gap lying in the plane of the connection lines is however also found to be advantageous for directional couplers which do not have external adjustment of the coupling attenuation because in this manner the balancing of the directional coupler during manufacturing can be carried out in particularly convenient manner.

As illustrated in dashed line in FIG. 3 the directional coupler may be equipped not only with connection lines leaving perpendicularly but also with inclined connection lines, particularly connection lines going out at less than 45°. In this case as well, it is possible to accommodate the movement of the inner conductor, which is very small in practice, by bending.

In FIG. 4 in the upper example of embodiment the plug connection 30 is arranged behind the first insulating support 26 and can thus simultaneously form the terminal point. It may however alternatively be disposed in front of the insulating support 26 if it is only to have the function of permitting the radial movement. In the lower example of embodiment according to FIG. 4 these resilient members 32 are in front of said first insulating support 26 so that in this case the inner conductor may be arranged in its insulating support without play.

I claim:

1. A directional coupler for adjusting the coupling attenuation by varying the air gap between the coupling lines to be coupled, said coupler comprising:

a first coupling line; first coaxial connection lines connected at opposite ends of said first coupling line; said first coaxial connection lines each extending away from said first coupling line in respective directions such that said first coaxial connection lines are generally in a plane;

a second coupling line; second coaxial connection lines connected at opposite ends of said second coupling line; said second coaxial connection lines each extending away from said coupling line in respective directions such that said second connection lines are generally in said plane;

said first and second coupling lines being positioned near each other, extending generally in the same direction over their entire lengths and being positioned such that they are separated from each other by a gap that is generally located in said plane; said first and second coupling lines being located at opposite sides of said gap and at opposite sides of said plane;

mechanical adjusting means connected with at least one of said coupling lines for adjusting the width of said gap between said coupling lines by moving said coupling lines relative to each other transversely to said plane.

2. The directional coupler of claim 1, wherein each said coupling line has a direction of extension and the respective said coaxial connection lines extend away from said coupling line in a direction other than said direction of extension.

3. The directional coupler of claim 2, wherein each said coupling line and its said coaxial connection lines are connected so as to define generally a U-shape.

4. The directional coupler of claim 1, wherein said mechanical adjustment means comprises:

a housing in which said coupler is contained;

a first insulating rod supported in said housing and connected to said at least one coupling line at one side of said at least one coupling line with respect to said gap;

a second insulating rod supported in said housing and connected to said at least one coupling line at the other side of said at least one coupling line with respect to said gap;

means for moving said second rod with respect to said housing, thereby to shift said at least one coupling line with respect to said gap to change the width of said gap.

5. The coupler of claim 4, wherein said first insulating rod is connected to said housing through a spring; said second insulating rod is connected to said housing through a threaded connection with said housing, whereby rotation of said second insulating rod moves that said rod longitudinally and moves said first insulating rod longitudinally against said spring.

6. The coupler of claim 4, further comprising a fixed support means for fixedly supporting the other of said coupling lines in said housing.

7. The coupler of claim 1, further comprising:

strips at the ends away from said coupling lines of at least some of said coaxial connection lines; said strips being oriented generally parallel to the length of the respective said coaxial connection line and extending beyond the end thereof; said strips being resilient and normally biased to squeeze against the respective said coaxial connection line and against a continuing line that is to be connected to the respective said coaxial connection line.

8. The coupler of claim 7, wherein said strips define a contact spring rim that is engageable with the respective said coaxial connection line.

9. The coupler of claim 7, further comprising a housing in which said coupler is contained; insulating supports on said housing through which each said coaxial connection line passes; and strips being so positioned and each said insulating support being so positioned that said strips of each said coaxial connection line are further from the respective said coupling line than said insulating support thereof.

* * * * *